United States Patent [19]

Kovac

[11] 4,085,511

[45] Apr. 25, 1978

[54] TELESCOPIC SIGHT GUN MOUNT

[76] Inventor: Joseph L. Kovac, 606 Beech Dr., Trafford, Pa. 15085

[21] Appl. No.: 732,207

[22] Filed: Oct. 14, 1976

[51] Int. Cl.[2] ..... F41G 1/38

[52] U.S. Cl. ..... 33/250; 33/248

[58] Field of Search ..... 33/247, 248, 249, 250, 33/245

[56] References Cited

U.S. PATENT DOCUMENTS

| | | | |
|---|---|---|---|
| 2,396,404 | 3/1946 | Williams et al. | 33/250 |
| 2,567,535 | 9/1951 | Willis et al. | 33/250 |
| 2,585,985 | 2/1952 | Anderson | 33/250 |
| 2,600,985 | 6/1952 | Fluty | 33/250 |
| 2,632,253 | 3/1953 | Stith | 33/248 |
| 2,641,057 | 6/1953 | Moore | 33/250 |
| 2,790,241 | 4/1957 | Dickenson | 33/250 |
| 3,324,558 | 6/1967 | Hart | 33/245 |

*Primary Examiner*—Richard E. Aegerter
*Assistant Examiner*—Richard R. Stearns
*Attorney, Agent, or Firm*—John B. Sotak

[57] ABSTRACT

This disclosure relates to an elevational and windage adjustable sight rifle mount for readily and rapidly attaching the scope to the rifle and for quickly and easily detaching the scope from the rifle. The mount includes a pair of spaced saddle assemblies fixedly secured to the receiver housing of the rifle. One of the saddle assemblies includes an inclined contact edge while the other assembly includes a flat deformable leaf spring. The scope is clamped to an elongated carrier having one end formed with a sloped or oblique surface which matches and engages the inclined contact edge and having the other end provided with a pivotal lever. One end of the pivotal lever includes a digital tab for being manipulated from an unlocked position to a locked position while the other end of the lever includes a rounded portion which frictionally engages a locking ledge and deflects the leaf spring to positively lock the scope to the rifle.

10 Claims, 4 Drawing Figures

TELESCOPIC SIGHT GUN MOUNT

FIELD OF THE INVENTION

This invention relates to a telescopic sight gun mount and, more particularly, to an adjustable rifle mount for rapidly and rigidly attaching a telescopic sight to the receiver of the action portion of the rifle and for quickly and easily detaching the telescopic sight from the receiver of the action of the rifle.

BACKGROUND OF THE INVENTION

The increased use of telescopic or telescope sights in the sport of hunting and shooting has produced a greater demand for better, more stable and easily separable scope mounts for rifles and other guns. It will be appreciated that an acceptable mount for hunters and target shooters must be capable of allowing the telescopic sight to be quickly and easily attached to and detached from the rifle without the need of special or ancillary tools. The criteria must hold true even during adverse weather, such as, on wet, cold or snowy times when it is necessary for the sportsman or hunter to wear gloves or mittens to protect his or her hands from the bitter and freezing atmospheric conditions. It is quite apparent that it is awkward, if not impossible, for an individual to handle a screwdriver, a wrench or a pair of pliers wearing gloves or mittens. Likewise, in freezing or sub-zero weather, the exposed hands and fingers of a hunter or shooter soon become numb, and he or she is greatly impeded in an attempt to loosen or tighten screws, bolts or other types of fasteners which were previously employed to securely hold the telescopic sight to the weapon. In order to alleviate the above-noted disadvantages, it has been previously proposed to utilize helical spring loaded plunger mechanisms, latching cams and notched devices as well as other types of resilent latching arrangements for mounting telescopic sights to firearms. These latter attempts have also failed to meet with general acceptance of many gun owners since misalignment problems frequently occur during handling and firing of the gun. It will be appreciated that heavy or large caliber rifles have a great amount of kick or recoil which is directly transmitted to the telescopic sight. These reactional forces or vibrational energy tends to cause frictional wear on the cammed and notched surfaces so that the mount eventually becomes loose and results in misalignment problems. Further, the springs of previous mounts are conducive to weakening and tend to lose their resiliency and tension due to aging and corrosion so that the scope becomes unsteady which causes inaccurate firing. In addition to the rifle recoil causing misalignment in previous mounts, the slightest mishandling of the rifle, such as, inadvertently grabbing or accidently bumping the telescope, results in inaccurate shooting. Thus, in order to achieve the highest degree of accuracy over an extended period of time, it is essential that a telescopic sight gun mount must be quickly and readily separable, must rigidly and securely hold the telescopic sight, must be capable of withstanding abuse and mishandling, must not be susceptible to excessive frictional wear and must not be adversely effected by inclement and unfavorable environmental conditions.

OBJECTS OF THE INVENTION

Accordingly, it is an object of this invention to provide a new and improved telescopic sight gun mount which alleviates the above-mentioned disadvantages.

Another object of this invention is to provide a unique mount and scope which is quickly and easily attached to and detached from a rifle.

A further object of this invention is to provide a novel rifle mount which furnishes a rigid and stable support for a telescopic sight.

Still another object of this invention is to provide a telescopic sight rifle mount which firmly locks the telescopic sight to the rifle yet readily permits the removal of the telescopic sight from the rifle.

Still a further object of this invention is to provide a steady and durable gun scope mount which is not susceptible to misalignment due to recoiling and mishandling of the gun.

Yet another object of this invention is to provide an adjustable rifle mount and scope which is readily and rigidly attached to the rifle and easily detached from the rifle.

Yet a further object of this invention is to provide a mount for readily connecting a telescopic sight to a gun and for quickly disconnecting the telescopic sight from the gun having a first and a second saddle spaced apart and fixedly secured to the gun, the first saddle including an oblique contact plane, the second saddle having a flat deflectable leaf member and having a lip, an elongated carrier having means for holding the telescopic sight, the elongated carrier having one end formed to agree and butt with the oblique contact plane and having a manipulatable lever pivotally connected to the other end of the elongated carrier, the manipulatable lever pivotally connected at the other end of the elongated carrier, the manipulatable lever having a finger grip formed on one end and having a rounded portion formed on the other end for frictionally engaging the lip and for deflecting the flat deflectable leaf member whereby the elongated carrier and telescopic sight are positively locked in fixed relationship with the first and the second saddles.

SUMMARY OF THE INVENTION

In accordance with the present invention, there is provided an adjustable telescopic sight mount which allows for rigid and rapid attachment of the telescopic sight to a rifle and which permits quick and easy detachment of the telescopic sight from the rifle. The mount includes an elongated carrier having a pair of split rings or bands for clamping around the central body or barrel of the telescopic sight. The mount includes a back and a front saddle assembly positioned at spaced points along the length of the receiver of the rifle. The back saddle assembly includes a U-shaped member which rests on an elevational adjusting shim member with screws fastening the U-shaped member and the shim member to the receiver. The front saddle assembly includes a U-shaped member which fits into a dovetailed slot formed in a base member which is screwed to the receiver of the rifle. A pair of large-headed adjusting screws permit lateral movement of the front saddle member relative to the base member to compensate for windage. The front end of the base member is provided with an oblique plane or inclined edge which matches a canted surface formed on one end of the elongated carrier. The underside of the other end of the elongated carrier is provided with a pivotal lever having a digital manipulatable portion formed on one end thereof for moving the pivotal lever between two extreme positions which is limited by a stop member. The back saddle assembly is provided with a flat deflectable blade or leaf member which is frictionally engaged and deformed by a rounded edge portion formed on the other end of the pivotal lever and is provided with a locking ledge which engages and deflects the lever for positively locking the elongated carrier and telescopic sight in fixed relationship with the back and front saddles and, in turn, on the rifle.

DESCRIPTION OF THE DRAWINGS

The foregoing objects and other attendent features and advantages will be more readily apparent and appreciated as the subject invention becomes more clearly understood by reference to the following detailed description when considered in conjunction with the accompanying drawings wherein.

DETAILED DESCRIPTION OF THE INVENTION

Figure 1:
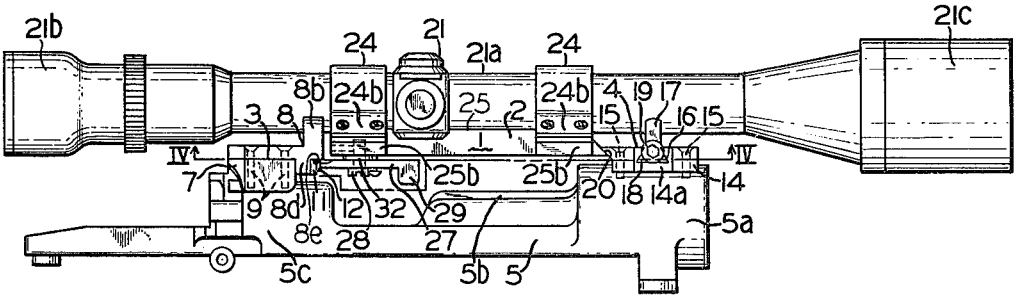
FIG. 1 is a fragmentary side elevational view of the receiver of a rifle having a mount in accordance with the present invention for attaching a telescopic sight to the rifle.

Referring to the drawings and, in particular, to FIG. 1, there is shown the adjustable gun mounting arrangement of the present invention which provides for positive and rigid attachment of a telescopic sight to a rifle or gun. As shown, the gun or rifle mount generally characterized by numeral 1 includes a separable elongated telescopic carrier 2 and a pair of cradle or saddle assemblies 3 and 4 which are fixedly secured in spaced relation to the top of the receiver housing of a bolt action type of rifle or firearm, such as, a 98 Mauser, Remington 700, Winchester 70 or the like.

Figure 2:
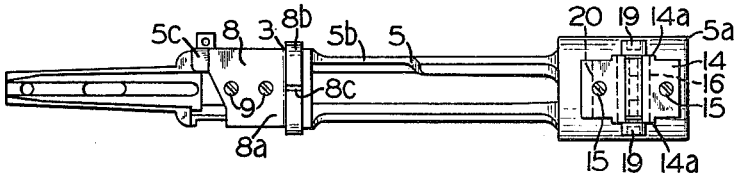
FIG. 2 is a top plan view of the receiver and the front and back saddle assemblies in spaced relationship with the telescopic sight and the elongated carrier detached.

As shown in FIGS. 1 and 2, the receiver 5 is generally constructed of high quality ordnance steel and includes a frontal cylindrical portion **5*a* having internal or female threads for receiving the threaded portion of a rifle barrel (not shown). The intermediate portion 5*b* is reduced and is formed with an undercut section for permitting the ejection of the spent brass shells or cartriges. A cylindrical or rounded back portion 5*c*** is adapted to accommodate the bolt body and knob (not shown). It will be appreciated that the rifle includes a suitable wooden stock to which the barreled action is appropriately attached.

Figure 3:
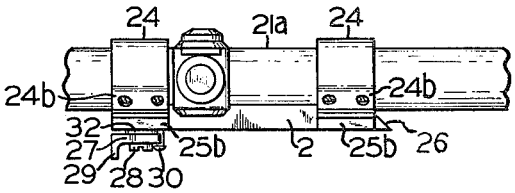
FIG. 3 is a fragmentary side elevational view of the telescopic sight and the elongated carrier separated from the rifle.
Figure 4:
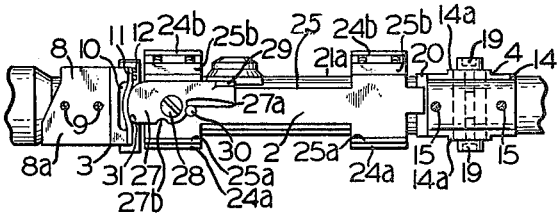
FIG. 4 is a cross-sectional view, taken along lines IV—IV of FIG. 1, of the elongated carrier and saddle assemblies with the telescopic sight in the locked position.

As shown in FIGS. 1, 2 and 3, the rounded back receiver portion **5*c* is provided with a pair of drilled and tapped holes (not characterized) for receiving suitable fasteners or screws as will be described presently. A plano-concaved metallic spacer or shim member 7 including matching through holes is arranged to have its hollow or curved undersurface fitted and placed on top of the rounded back portion 5*c* of the receiver housing. It will be appreciated that the thickness or vertical height of the shim member 7 may be varied and specifically selected to provide an elevational adjustment for different variations in the trajectory and characteristics of a given caliber of bullet and should be selected in accordance with the test results of the manufacturer. The top or upper surface of the shim member 7 is arranged to support a back cradle or saddle member 8. The saddle 8 includes a rearwardly projecting flat rectangular platen 8*a* which rests on the flat surface of shim member 7. The platen member 8*a* includes a pair of countersunk holes which are adapted to be aligned with the two holes drilled in shim 7 and the two threaded holes located in the receiver portion 5*c*. A pair of flat headed machine screws 9 are fitted into the aligned holes and are tightened to securely hold the saddle and shim members in position on the receiver. As shown, the forward end of the saddle 8 includes a U-shaped or concaved portion 8*b* which accommodates the central body or intermediate barrel section of a telescopic sight or scope, as will be described in greater detail hereinafter. The lowest middle extremity of the concaved surface of the U-shaped portion 8*b* includes a scored furrow or V-notch 8*c* which functions as an open iron sight when the telescopic sight is not attached to the rifle. The forward end of the back saddle 8 also includes a depending leg or portion 8*d* having an inner corner and surface which bear against the front edge of shim 7 for assisting in positioning and holding the saddle member 8 on the shim member 7. As shown in FIG. 4, a central recess or cutout 10 and an upper lip or horizontal contact ledge 8*e* are formed in the front side of depending leg portion 8*d*. The recess 10 is spanned or bridged by a relatively long and narrow blade or flat parallel deflectable leaf spring member 11 which is securely held in position by fillister headed machine screw 12. The elongated leaf spring 11** is constructed of suitable resilient metal, such as, stainless steel or the like, which has high resistance to fatigue, corrosion and wear.

Referring now to FIGS. 1, 2 and 4, it will be appreciated that the front portion **5*a* of receiver housing 5 is also drilled and tapped for reception of a pair of retaining screws which will be described presently. The front saddle assembly 4 includes a base member 14 having a hollowed-out or concaved underside positioned on and aligned with the two threaded holes formed in the receiver portion 5*a*. A pair of flat headed machine screws 15 are fitted into the countersunk holes drilled in the base member 14 and are tightened to securely hold the member 14 on the receiver housing 5. As shown in FIGS. 1, 2 and 4, each side of the base member 14 is provided with a lateral extending step portion or side ledge 14*a* which has a flat or plane edge. Further, the upper surface or top of the base member 14 is provided with a centrally located lateral mortise or dovetail slot 16 which extends the width of the base member 14. An upstanding front saddle or cradle member 17 having a matching tenon or dovetail 18 is formed on its lower extremity is slidably disposed within the mortise 16. A through hole is drilled and tapped in the tenon portion 18 of the saddle 17, and a large headed cap screw or machine bolt 19 having a hexagonal socket is threaded into each end of the hole 19 to provide a windage adjustment. Thus, by loosening one of the screws 19 and by tightening the other screw, the saddle member 17 is laterally shifted in relation to the base 14 to compensate for windage. That is, the saddle 17 is shifted in the dovetail slot 16 by initially turning one of the screws 19 in a counterclockwise direction and then turning the other screw 19 in a clockwise direction which causes the underside of the head of the screw to engage the flat edge of the step 14***a* and draws the saddle member 17 toward the rotated screwhead. After appropriate adjustment, the saddle 17 is locked in position by rotating the initial screw 19 in a clockwise direction. Like saddle 8, the upper portion of saddle 17 is U-shaped or semicircular to provide a seat for the barrel of the telescopic sight, as will be described presently. As shown in FIG. 1, the rearward or back edge of base member 14 is provided with an approximately 45° undercut or inclined edge or surface 20, the purpose of which will be described hereinafter.

As previously mentioned, the mount 1 also includes an elongated metallic carrier 2 which provides a seat and supports a tubular telescopic sight or scope 21 having an intermediate barrel or central body 21*a*, an eye piece 21*b* and an objective lens end 21*c*. As shown, the carrier 2 is provided with a pair of suitable sized split rings or half bands 24 which fit around the upper peripheral surface of barrel 21*a* and are securely fastened intermediate the ends of carrier bar 25. In practice, one end of each of the half rings 24 includes a hook-like portion 24*a* which catches onto a furrowed portion 25*a* formed on elongated bar 25. The other end 24*b* of each of the half rings 24 is attached to a projection 25*b* by a pair of suitable flat headed machine screws (not characterized). Thus, the telescopic sight 20 and the longated carrier 2 form a solid and integral structure which may be easily handled by the individual. It will be seen that the front end or forward extremity of the bar 25 is provided with an approximately 45° sloped or canted surface 26 which matches the inclined edge 20 of base member 14. A stainless steel pivotal lever 27 is rotatably mounted near the other end of the bar member 25. As shown, the pivotal lever 27 is connected to the underside of bar 25 by a fillister headed or shouldered machine screw 28. The screw 28 passes through a hole located substantially in the center of the lever 27 and through a spacing washer 32 situated between lever 28 and bar 25. The spacer or washer 32 is preferably made of "Teflon" or "Celcon" or some other self-lubricating material and acts as a standoff to avoid direct contact between the surfaces of the bar 25 and lever 27 thereby reducing wear and facilitating movement of the lever. As shown, one end of the lever 27 is provided with a depending finger tab or digital piece 29 which may be manipulated by the thumb and index finger to rotate the lever approximately 90° between a locked and an opened position. It will be noted that a stop member 30 is provided on and depends from the underside of bar 25 for cooperating with notches 27*a* and 27*b* formed in the edge of lever 27 to limit its movement between the two extreme positions. The leading edge of the other end 31 of lever 27 is slightly curved or rounded to physically and frictionally contact the exposed surface of blade or leaf spring 11 to bend and cause deformation of the leaf spring member 11 as shown slightly exaggerated in FIG. 4. When the lever 27 is in its locked position, the upper surface or top of the lever contacts and engages the horizontal lip 8*e* and the side edge of the engaging end 31 hits and rests against the leaf spring member 11 to positively retain it in position.

Initially, let us assume that the telescopic sight 20 is separated from the gun or rifle and that it is desired to mount the scope onto the rifle. The scope 20 is simply grasped by the intermediate barrel 21*a* by the individual. Prior to placement onto the rifle, the individual should check to ensure that the lever 27 is in its opened position, as shown in FIG. 3, wherein the longitudinal axis of the lever 27 is transverse to the longitudinal axis of the elongated carrier 2. Next the individual slips the slopped planar end 26 of the carrier 2 under and against the inclined surface 20 of the front saddle assembly, and at the same time he slips and cradles the front portion of the central barrel 21*a* onto the concaved or U-shaped surface of saddle 17. Then the individual merely lowers and rests the back portion of the central barrel 21*a* onto the concaved portion of the U-shaped saddle 8. The telescopic sight 20 is positively locked in position by pushing the thumb piece 29 under the bar 25 by rotating the lever 27 approximately 90° to the position as shown in FIGS. 1 and 4. It will be appreciated that rotation of lever 27 causes the top surface of lever 27 to engage the lip 8*e* and also causes its rounded end 31 to come in contact and to frictionally engage the outer or exposed surface of leaf spring 11, and continued movement results in the bending and slight deformation of the spring 11, as shown in FIG. 4. The deformation and resiliency of the leaf spring or stainless steel blade 11 causes a constant force to be exerted between the carrier member 2 and the saddle assemblies 3 and 4, and the engagement of the contact lip 8*e* and the top of end portion 31 slightly deflects or bends the lever 27 so that the telescopic sight 20 is rigidly and unyielding attached to the receiver of the rifle. Once the scope is adjusted and set, it will not wobble, shake or move even when mounted on and fired from a high powered magnum type of rifle, and, in fact, the entire rifle may be picked up by grasping the barrel 21*a* of the scope 21 without causing any loosening or misalignment. Thus, the telescopic sight may be easily and rapidly mounted in several seconds. Now if it is preferable to have open iron sights, the rifleman may quickly and readily detach the scope by simply pulling the finger tab 29 and rotating the lever 27 so that the rounded edge 31 moves out of engagement with the leaf spring 11 and the top surface clears and disengages the locking lip 8*e*. Then he merely lifts the scope 20 and carrier 2 off of the receiver of the rifle, and he is ready to aim with the V-notched groove 8*c* and the front iron sight mounted on the front end of the rifle barrel.

Ergo, an individual may promptly attach and detach the telescopic sight in a matter of seconds even in adverse weather while wearing gloves or mittens and without the need of special tools or ancillary devices. It will be appreciated that the scope 20 and carrier may be transferred and used on other rifles which are equipped with front and back saddle assemblies. Thus, the same scope and carrier may be transferred and interchanged with a minimum of effort and adjustment, namely, only the windage adjustment should be necessary to attain accurate shooting results.

It will be appreciated that the details of the invention, as seen, shown and disclosed in the drawings and foregoing description, are to be considered as illustrative and not restrictive in nature. Accordingly, it is understood that various changes, alterations and modifications may be made by persons skilled in the art without departing from the spirit and scope of this invention. Thus, it is apparently obvious that numerous modifications and changes can be made in practicing the presently described invention, and therefore, it is understood that all alterations, variations and equivalents producing substantially the same results with substantially the same features in substantially the same way as this invention are herein meant to be encompassed in the appended claims.

Having now described the invention what I claim as new and desire to secure by Letters Patent, is:

1. A mount for readily attaching a telescopic sight to a gun and for quickly detaching the telescopic sight from the gun comprising, first and second saddle means spaced apart and fixedly secured to the gun, said first saddle means having a rearwardly facing angular contact edge, said second saddle means having a forwardly facing flat deflectable leaf member and a locking lip adjacent to said leaf member and extending orthogonally to the plane of said leaf member, an elongated carrier having one end formed to agree and to abut with said angular contact edge, and a manipulatable lever pivotally connected at the other end of said elongated carrier for movement about an axis extending orthogonally to the plane defined by said locking lip and having a portion for frictionally engaging said locking lip and deflecting said flat deflectable leaf member whereby said elongated carrier and the telescopic sight are positively locked in fixed relationship with said first and said second saddle means.

2. The mount as defined in claim 1, wherein said flat deflectable leaf member extends laterally in relation to the longitudinal axis of said elongated carrier.

3. The mount as defined in claim 1, wherein said manipulatable lever includes a grip portion for moving said lever between a locked and an unlocked position.

4. The mount as defined in claim 3, wherein a stop member is attached to said elongated carrier for engaging notches formed on said manipulatable lever to limit the movement of said manipulatable lever between the locked and unlocked positions.

5. The mount as defined in claim 1, wherein each of said first and said second saddle means includes an upper concaved portion for accommodating the cylindrical body of the telescopic sight.

6. The mount as defined in claim 1, wherein said angular contact edge is in the form of an approximately a 45° angle.

7. The mount as defined in claim 1, wherein said first saddle means includes a base member which is screwed to the gun and includes a laterally adjustable U-shaped member.

8. The mount as defined in claim 7, wherein said base member and said U-shaped member includes a cooperating dovetail groove and tenon to permit lateral movement.

9. The mount as defined in claim 7, wherein said U-shaped member includes a lateral tenon having a pair of adjusting screws to allow for windage adjustment.

10. The mount as defined in claim 1, wherein said second saddle means includes a replaceable shim member for providing for elevational adjustment and includes an upper U-shaped member for accommodating the cylindrical body of the telescopic sight.

* * * * *